United States Patent [19]

Turner

[11] Patent Number: 4,684,136

[45] Date of Patent: Aug. 4, 1987

[54] COMBINATION TIC-TAC-TOE AND QUESTION AND ANSWER GAME

[76] Inventor: Philip Turner, 2 Walter Ct., Bethpage, N.Y. 11804

[21] Appl. No.: 743,043

[22] Filed: Jun. 10, 1985

[51] Int. Cl.[4] ..... A63F 3/00

[52] U.S. Cl. ..... 273/271; 273/146; 273/240; 434/327; 434/347

[58] Field of Search ..... 273/271, 240; 434/327, 434/347

[56] References Cited

U.S. PATENT DOCUMENTS

| | | | |
|---|---|---|---|
| 2,717,156 | 9/1955 | Nelson | 273/248 |
| 3,023,004 | 2/1962 | Pitts | 273/271 |
| 3,549,150 | 12/1970 | Weeks | 273/269 |
| 4,000,897 | 1/1977 | York | 273/93 C |
| 4,124,214 | 11/1978 | Pavis | 273/249 |
| 4,131,282 | 12/1978 | Boyer | 273/271 |

OTHER PUBLICATIONS

Trivial Pursuit, rules of play and typical game question & answer card ©1981.

*Primary Examiner*—Anton O. Oechsle
*Attorney, Agent, or Firm*—Michael I. Kroll

[57] ABSTRACT

A game apparatus is provided and consists of nine tic-tac-toe arrangements whereby two teams answer questions until three tic-tac-toe arrangements are won in a vertical, horizontal or diagonal row to completely win the game.

3 Claims, 4 Drawing Figures

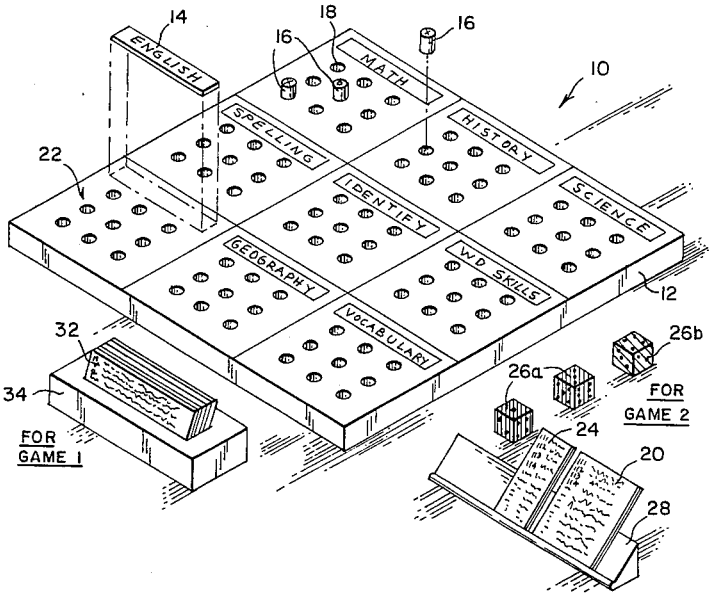

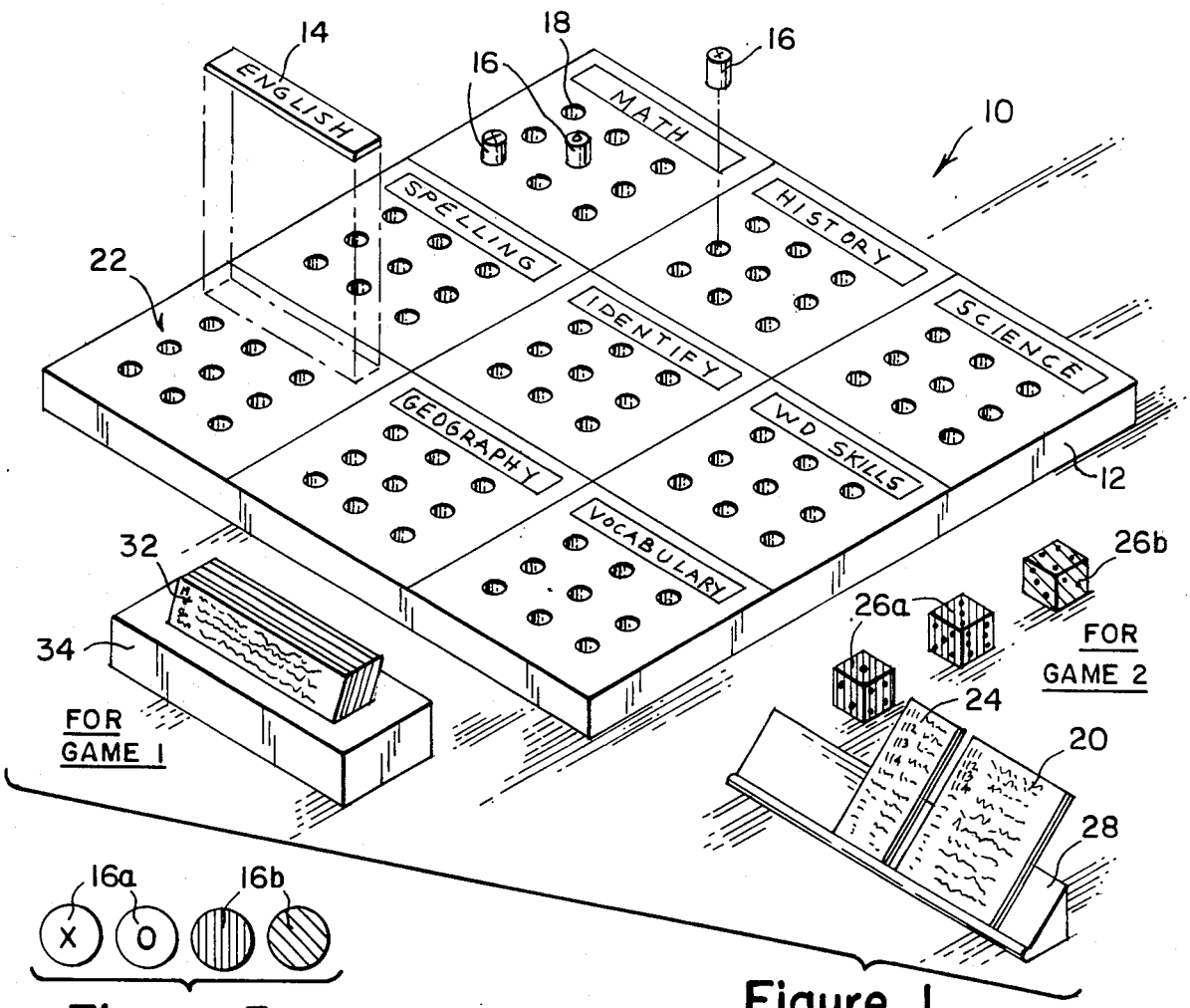

Figure 1

Figure 3

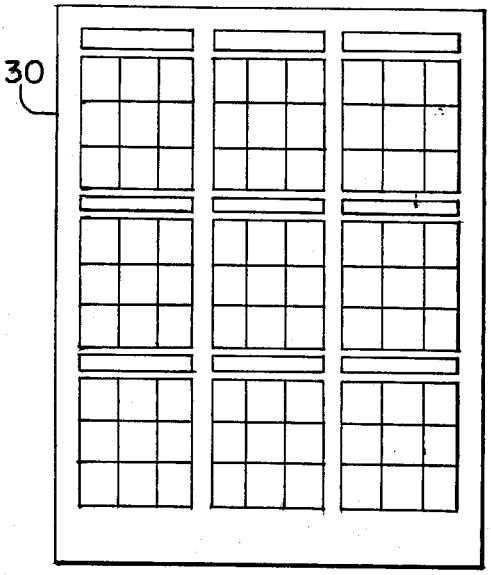

Figure 2

36

| EQUIPMENT | GAME 1 | GAME 2 | GAME 3 |
|---|---|---|---|
| BOARD | NINE TIC-TAC-TOES | NINE TIC-TAC-TOES | NONE |
| DISCS | X, O, OR COLORS | X, O, OR COLORS | NONE |
| DICE | NONE | 2 RED, 1 GREEN | NONE |
| QUESTION CARDS | 9 QUESTIONS, 1 FROM EA. SUBJ. OVER 100 CARDS PER LEVEL | 2 CARDS, 1 SUBJECT WITH 126 QUESTIONS PER LEVEL | NONE |
| ANSWER CARDS | ANSWERS ON BACK OF QUESTION CARDS | EACH CARD ONE SUBJECT WITH 126 ANSWERS | NONE |
| RACK OR BOX | BOX FOR SETTING UP CARDS | RACK FOR SETTING UP CARDS | NONE |
| COMPUTER DISK | NONE | NONE | SOFTWARE HAS QUESTIONS AND ANSWERS |
| TV MONITOR OR CRT SCREEN | NONE | NONE | USER FRIENDLY GRAPHICS-SHOWS QUES., ANS. & 9 TIC-TAC-TOES |
| PRINTED PAPER | OPTIONAL IN LIEU OF BOARD | OPTIONAL IN LIEU OF BOARD | OPTIONAL IN LIEU OF TIC-TAC-TOE ON TV MON. |

Figure 4

COMBINATION TIC-TAC-TOE AND QUESTION AND ANSWER GAME

BACKGROUND OF THE INVENTION

1. Field of Invention

The instant invention relates generally to games and more specifically it relates to a game apparatus for playing tic-tac-toe games.

2. Description of the Prior Art

Numerous games have been provided in prior art that are adapted to be played in different ways. For example, U.S. Pat. Nos. 1,714,792; 1,760,642; 3,023,004; 3,048,403 and 3,873,095 all are illustrative of such prior art. While these units may be suitable for the particular purpose to which they address, they would not be as suitable for the purposes of the present invention as heretofore described.

SUMMARY OF THE INVENTION

A principle object of the present invention is to provide a game apparatus for playing tic-tac-toe games that combines strategy and knowledge.

Another object is to provide a game apparatus for playing tic-tac-toe games wherein the strategy is that of a tic-tac-toe game, but on a multiple basis and the knowledge deals with elementary and secondary school subject areas by grade level.

A further object is to provide a game apparatus for playing tic-tac-toe games that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

FIG. 1 is a perspective view of the invention for game variations one and two.

FIG. 2 is a top plan view of the printed paper to be used in place of the game board or computer monitor.

FIG. 3 is a top plan view of each of the various scoring pieces.

FIG. 4 is a chart showing equipment needed for the three different game variations.

DETAILED DESCRIPTION OF THE PREFERRED EMBODIMENTS

Turning now descriptively to the drawings, in which similar reference characters denote similar elements throughout the several views, FIG. 1 illustrates a game apparatus 10 that contains two game variations indicated as game 1 and game 2. Game 1 contains a playing board 12, a plurality of playing cards 32, a holder 34 and two different sets of playing pieces 16. Game 2 contains a playing board 12, a plurality of playing cards 20 and 24, a holder 28, two different sets of playing pieces 16, and dice 26*a*, 26*b*.

The playing board 12 and the playing pieces 16 are the same for both games 1 and 2. The playing board 12 has a plurality of apertures 18 forming nine tic-tac-toe arrangements 22 organized in a square pattern. Each tic-tac-toe arrangement 22 is labeled as a different subject area, such as Math, History, Science, Spelling, Identify, Word Skills, English, Geography, Vocabulary or the like. A label 14 can be permanently attached to the playing board 12 or be removable therefrom. The two different sets of playing pieces can have "x" and "o" on them as indicated by 16*a* or be in two different colors as indicated by 16*b* in FIG. 3.

In game 1 each playing card 32 contains nine questions, one from each subject area, on one side and answers to the question on the other side. The holder 34 is a box for setting up the playing cards 32. Each set of playing pieces 16 is used by each player for scoring when questions are answered correctly. Each playing piece 16 is placed into an aperture 18 on the playing board 12 until three tic-tac-toe arrangements 22 are won in a vertical, horizontal or diagonal row to completely win the game.

In game 2 each playing card 20 contains a plurality of consecutively numbered questions from one subject area, on one side and answers to the questions on the other side. Dice 26*a* and 26*b* are for randomly choosing one of the numbered questions to be answered by one of the players. Separate answer cards 24 can be provided instead of placing the answers on back of the playing cards 20. The holder 28 is a rack for setting up the playing cards 20 and answer cards 24. The playing pieces 16 are used in the same manner as described in game 1 above.

In FIG. 4 a chart 36 is shown showing the equipment needed for games 1 and 2. Another variation, game 3, is listed in the chart as a computer game. The equipment needed is a computer with a monitor capable of showing the nine tic-tac-toe grids. Also required are computer disks programmed to run the game.

In FIG. 2 a printed paper 30 is shown with a diagram of the nine tic-tac-toe grids. It can be used to play the game mentioned above. The printed paper 30 can be used to replace the playing board 12 or the computer monitor for scoring purposes. The monitor still has to be used to ask and answer questions.

The grade levels indicated on the playing cards 20 or 32 are appropriate for that grade level. This in no way means that the subject area is not used on other grade levels, because there is an overlapping of topics from one grade level to another.

The game is a contest between two teams. The teams could consist of one player each, two players each, etc. When questions are answered, the teams can answer as a group, or each individual member of the team can answer individually. This should be decided at the beginning of the game by the players.

At the beginning of the school year, it is suggested that players play the game on the previous year's grade level. As the year progresses the students gain in grade level ability, players would be more likely to do well in answering questions at their level.

Some students are capable of answering questions at more advanced levels at any time during the school year. Competition at different grade levels should be agreed upon at the beginning of the game. It is possible to have a game with individuals competing at different grade levels.

The object of the game is for one team to win three tic-tac-toe subject areas 22 in a row (vertically, horizontally, or diagonally). For example, as illustrated in FIG. 1: If a team should win Math, History, and Science, it would win the game, because it has won three tic-tac-toe subject areas in a horizontal row. At the beginning of the game, the teams choose to see which team goes first. The team that goes first can select any category it wants. Each time a player answers a queston correctly, playing piece 16 is placed in the selected category. If a team misses a question, it fails to score and the opposing team gets another chance to score. In order to win the game, one team must win three tic-tac-toe subject areas in a row (vertically, horizontally, or diagonally).

The above description for scoring applies to both games one and two with this exception: In game one, the players can go anywhere on the board that is open for scoring. In game two, the team that goes first can select any subject area it wants for its first question. The team that goes second must stay with this topic. The first subject area must be resolved (win, lose, or tie) before moving on to another subject area. For example, if a team scores three in a row in Geography, it wins Geography. The losing team can then select a question from another subject area, but not before Geography is resolved. This procedure cuts down on card manipulation.

If it becomes evident that no team can score three consecutive tic-tac-toe subject areas 22 in a row because of tie games, then the winning team is determined on a point scale. This can be done simply by counting out the total number of playing pieces 16 and the team with the greatest total wins.

The playing cards 20 or 32, should not be handled by the team answering the questions. The opposing team should ask the questions and handle the cards. In some cases such as a long matching question, the team that is being questioned should be allowed to view the playing card because of the many possible answers that are available. Time limits for answering should be established by the players at the beginning of the game.

In game 1 played with no dice, questions from all nine subject areas appear on each playing card 32. An opposing player picks a playing card for the player whose turn it is. The player whose turn it is has selected a category (Geography) and his opponent reads the geography question from the front of the card. The answers to all nine category questions are on the back of the cards. The only exceptions to this procedure are in the case of some identification questions, geography map questions, or other categories. In these cases, the player is referred to a larger card for the question.

In game 2 played with dice, 126 questions are possible for each subject area by using the dice key. Three dice are required (two red 26*a* and one green 26*b*). When rolling the dice, the two red dice 26*a* occupy the ten's and hundred's place with the lower die number always going to the hundred's place. The green die 26b always occupies the one's place.

The numbers that result from this dice key are as follows:

| | | | | | | | |
|---|---|---|---|---|---|---|---|
| 111 | 121 | 131 | 141 | 151 | 161 | 221 | 231 |
| 112 | 122 | 132 | 142 | 152 | 162 | 222 | 232 |
| 113 | 123 | 133 | 143 | 153 | 163 | 223 | 233 |
| 114 | 124 | 134 | 144 | 154 | 164 | 224 | 234 |
| 115 | 125 | 135 | 145 | 155 | 165 | 225 | 235 |
| 116 | 126 | 136 | 146 | 156 | 166 | 226 | 236 |
| 241 | 251 | 261 | 331 | 341 | 351 | 361 | 441 |
| 242 | 252 | 262 | 332 | 342 | 352 | 362 | 442 |
| 243 | 253 | 263 | 333 | 343 | 353 | 363 | 443 |
| 244 | 254 | 264 | 334 | 344 | 354 | 364 | 444 |
| 245 | 255 | 265 | 335 | 345 | 355 | 365 | 445 |

-continued

| | | | | | | | |
|---|---|---|---|---|---|---|---|
| 246 | 256 | 266 | 336 | 346 | 356 | 366 | 446 |
| 451 | 461 | 551 | 561 | 661 | | | |
| 452 | 462 | 552 | 562 | 662 | | | |
| 453 | 463 | 553 | 563 | 663 | | | |
| 454 | 464 | 554 | 564 | 664 | | | |
| 455 | 465 | 555 | 565 | 665 | | | |
| 456 | 466 | 556 | 566 | 666 | | | |

EXAMPLE

| RED | RED | GREEN | NUMBER |
|---|---|---|---|
| 4 | 5 | 1 = | 451 |

If during the game a player rolls the same number again, he is to roll again.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A game apparatus which comprises:

(a) means for forming nine tic-tac-toe arrangements in a square pattern, each said tic-tac-toe arrangement being labeled as a different subject area, said forming means including a playing board having a plurality of apertures;

(b) a plurality of playing cards having questions and answers to said questions, said questions and said answers being of grade level in difficulty, said playing cards having consecutively numbered questions and answers;

(c) a holder for setting up said playing cards;

(d) means for scoring when said correct questions are answered until three said tic-tac-toe arrangements are won in a vertical, horizontal, diagonal row to completely win said game, said scoring means including two different sets of playing pieces used by each player by placing each said playing piece into one of said apertures on said playing board; and (e) means for randomly choosing one of said numbered questions to be answered by one of said players, said randomly choosing means further comprising two dice being of one color so that when rolling said dice they will occupy the tens and hundreds place with lower die number always going to said hundreds place, and one die being of another color so that when rolling said die it will always occupy the ones place, thus three said dice will indicate a three digit number corresponding to one of said numbered questions on one of said playing cards.

2. A game apparatus as recited in claim 1, wherein each said playing card includes a plurality of questions from one said subject area, on one side and answers to said questions on other side.

3. A game apparatus as recited in claim 1, wherein said playing cards further comprises:

(a) a first set of question cards, each said question card includes a plurality of questions from one said subject area; and (b) a second set of answer cards, each said answer card includes matching answers from one said subject area.

* * * * *